US010648176B2

(12) United States Patent
Olarte Michel

(10) Patent No.: US 10,648,176 B2
(45) Date of Patent: May 12, 2020

(54) PRECAST BLOCK AND INSTALLATION SYSTEM FOR CONSTRUCTION OF WALLS AND SLABS

(71) Applicant: Manuel Humberto Olarte Michel, Guadalajara (MX)

(72) Inventor: Manuel Humberto Olarte Michel, Guadalajara (MX)

( * ) Notice: Subject to any disclaimer, the term of this patent is extended or adjusted under 35 U.S.C. 154(b) by 0 days.

(21) Appl. No.: 15/287,462

(22) Filed: Oct. 6, 2016

(65) Prior Publication Data

US 2018/0100302 A1 Apr. 12, 2018

(51) Int. Cl.
*E04B 2/24* (2006.01)
*E04B 2/16* (2006.01)
(Continued)

(52) U.S. Cl.
CPC ..... *E04B 2/24* (2013.01); *E04B 1/043* (2013.01); *E04B 2/08* (2013.01); *E04B 2/16* (2013.01);
(Continued)

(58) Field of Classification Search
CPC ... E04B 2/24; E04B 1/043; E04B 1/88; E04B 2/02; E04B 5/02; E04B 2002/0289;
(Continued)

(56) References Cited

U.S. PATENT DOCUMENTS 1,566,228 A * 12/1925 Ryan ..... E04B 2/42 52/286
3,534,518 A * 10/1970 Zagray ..... E04B 2/46 52/258
(Continued)

FOREIGN PATENT DOCUMENTS

FR 2731733 A1 * 9/1996 ..... E04B 2/02
GB 1342420 A * 1/1974 ..... E04B 5/02

OTHER PUBLICATIONS

Machine translation for foreign reference FR2731733A1, obtained from http://translationportal.epo.org/emtp/translate/?ACTION=description-retrieval&COUNTRY=FR&ENGINE=google&FORMAT=docdb&KIND=A1&LOCALE=en_EP&NUMBER=2731733&OPS=ops.epo.org/3.2&SRCLANG=fr&TRGLANG=en (last accessed on Aug. 18, 2017).*

*Primary Examiner* — Theodore V Adamos

(74) *Attorney, Agent, or Firm* — Miguel Villarreal, Jr.; Gunn, Lee & Cave, P.C.

(57) ABSTRACT

Precast blocks with a rectangular or quadrangular prism shape contain a normal weight hydraulic concrete casing, lightweight concrete or similar material, for building walls or slabs. The steel-reinforced blocks for walls, mezzanine or rooftop slabs have the length of the wall or slab to build. An acoustic, thermal-insulating lightweight material housed in the interior simultaneous provides for blocks sufficiently lightweight to transport and install manually on-site. For walls, the blocks are tongued and grooved on the top and bottom sides and placed horizontally one on top of the other using block or similar adhesive therebetween. In the corners or "T" intersections, blocks are alternatively placed and form armed headframes for stability and resistance. For blocks for slabs, the tongue and groove system is on the sides, installed one beside the other, using block or similar adhesive therebetween. Transversal rods to the slab are placed to avoid temperature retraction.

8 Claims, 12 Drawing Sheets

(51) Int. Cl.

| | |
|---|---|
| ***E04B 2/08*** | (2006.01) |
| ***E04B 5/02*** | (2006.01) |
| ***E04B 1/04*** | (2006.01) |
| ***E04B 2/02*** | (2006.01) |
| ***E04C 1/39*** | (2006.01) |
| ***E04C 1/41*** | (2006.01) |
| ***E04C 2/288*** | (2006.01) |
| ***E04C 2/52*** | (2006.01) |

(52) U.S. Cl.
CPC ..... *E04B 5/02* (2013.01); *E04C 1/39* (2013.01); *E04C 1/397* (2013.01); *E04C 1/41* (2013.01); *E04C 2/2885* (2013.01); *E04C 2/521* (2013.01); *E04B 2002/0204* (2013.01); *E04B 2002/0208* (2013.01); *E04B 2002/0243* (2013.01); *E04B 2002/0254* (2013.01)

(58) Field of Classification Search
CPC ..... E04B 2002/0293; E04B 2/16; E04B 2/08; E04B 2002/0204; E04B 2002/0243; E04B 2002/0208; E04B 2002/0254; E04C 1/39; E04C 1/41; E04C 1/397; E04C 2/521; E04C 2/2885
USPC ..... 52/309.12, 223.7, 602, 606, 607, 592.6, 52/604
See application file for complete search history.

(56) References Cited

U.S. PATENT DOCUMENTS 4,292,783 A * 10/1981 Mulvihill ..... E04B 1/76 52/309.12
4,688,362 A * 8/1987 Pedersen ..... E04B 2/08 52/223.7
4,942,702 A * 7/1990 Lemasson ..... E04C 2/288 52/127.7
5,248,122 A * 9/1993 Graham ..... E04C 2/044 249/91
5,647,185 A * 7/1997 Forlini ..... E04B 2/06 405/284
5,899,040 A * 5/1999 Cerrato ..... E04B 2/08 52/223.7
6,026,628 A * 2/2000 Lopez ..... E04B 2/84 52/309.12
6,244,009 B1 * 6/2001 Cerrato ..... E04B 2/08 52/223.7
6,418,686 B1 * 7/2002 Record ..... E04C 2/288 52/284
6,665,994 B1 * 12/2003 Ruggeri ..... E04B 2/14 52/592.6
7,062,885 B1 * 6/2006 Dickenson, Jr. ..... E02D 27/02 52/274
7,165,374 B2 * 1/2007 Ohanesian ..... B28B 7/0073 52/309.12
8,800,230 B2 * 8/2014 O'Connor ..... E04B 2/16 52/442
9,234,349 B1 * 1/2016 Daiber ..... E04C 2/06
2001/0045077 A1 * 11/2001 Miller ..... E04C 2/288 52/745.19
2002/0043038 A1 * 4/2002 Cerrato ..... E04B 1/703 52/604
2007/0199266 A1 * 8/2007 Geilen ..... E04B 2/8629 52/309.12
2011/0072753 A1 * 3/2011 MacDonald ..... E02D 29/025 52/562
2013/0061549 A1 * 3/2013 Biadora ..... E04B 2/06 52/503
2013/0333313 A1 * 12/2013 Alsayed ..... E04B 2/54 52/220.1

* cited by examiner

PRECAST BLOCK AND INSTALLATION SYSTEM FOR CONSTRUCTION OF WALLS AND SLABS

CROSS REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The present invention is linked to the construction industry in general, particularly to the prefabrication of construction elements of walls and slabs for homes, schools, commercial spaces, hotels, and condominiums, among other applications. Specifically, the present invention is directed to a construction system based on precast normal weight hydraulic concrete quadrangular or rectangular prism-shaped blocks, lightweight concrete, mortar, cement paste or any other material for similar constructions that can be used reinforced to support the loads of its own weight and working loads under which it is submitted. It includes in its interior, thermal and acoustic insulating materials. The precast blocks will be the length of the wall or width of the slab.

2. Description of the Art

Currently, in construction, there are numerous precast blocks for on-site construction of walls and slabs, different materials, both natural as well as artificial ones with quite diverse physical and mechanical properties.

Generally, blocks are used to fabricate walls, which are relatively small pieces that when installed produce many joints to be glued together using a mortar, with the consequent waste of material and a large volume of labor, for example: pressed hollow blocks of cement mortar mixed with sand or pumice mortar, hollow pressed clay blocks, pressed cinder blocks of cement mortar mixed with sand, baked clay or clay solid bricks, clay hollow bricks or pressed and baked clay bricks, thermoclay, pressed soil bricks or cinder blocks, adobe bricks, Hebel blocks, besides other of similar types. There are also larger precast armed hydraulic concrete blocks, that due to their weight and size the use of cranes is needed for their installation or lifting, ending in higher costs and complicated maneuvers, along with troubles in the constructions joints due to cracking. Another precast system uses 2-sides Durock sheets or adhered fiber cement expanded polystyrene blocks of the length and thickness of the wall and with a modulated block banking to its height. Even when it is reinforced with mortar sunken rods directly embedded into the polystyrene block, this system is quite fragile. It neither withstands heavy loads nor can it be directly pounded and it is not better than a drywall or Durock system.

To fabricate slabs, cement-sand pressed hollow blocks are used or cement-pumice stone or pressed clay hollow blocks or expanded polystyrene blocks are also used, forming infill blocks as lightening elements for concrete reticular slabs. Cement-sand or cement-pumice stone hollow pressed and baked clay arch-shaped blocks are also used; all these sustained between beams, whether of concrete or steel, into which a layer of hydraulic concrete compression layer must be poured. Of course there are the armed hydraulic concrete precast slab blocks, either prestressed or poststressed, which, given their weight and footprint, also need cranes for their lifting and installation.

BRIEF SUMMARY OF THE INVENTION

Objectives of the Invention

A major objective of the present invention is the obtaining of a precast block system for construction of walls and slabs that is sufficiently lightweight for blocks forming the walls or slabs to be easily and rapidly manually installed but being of a size that covers the length of the walls and width of the slabs of any size of house, schoolroom, hotel room or condominium, among other applications. Its block height will be modulated at the height of the wall layout and at the height of the closure of doors and windows of the same wall. In the case of the slabs, whether mezzanine levels or rooftops, they can be modulated to adjust to the width of the slab.

Another objective not less important is to bring safety and stability of the constructions, even in zones of seismic regions or susceptible to strong winds or snowfalls. The walls will be structured in the corners and in the crossing of the walls through the use of sunken steel rods in the extremes of the blocks making the walls, forming the headframes, using steel rod abutments installed in the joints between the blocks. The reinforcement area will be calculated to provide stability to the construction of one or several levels. The blocks that form the mezzanine or rooftop slabs will be reinforced with steel electrowelded wire mesh or rods to withstand their own loads and the working load to which they will be submitted.

Another objective of the present invention is to offer comfort and energy savings inside houses, schoolrooms, hotels, and condominiums, among other applications, given the thermal and acoustic insulation provided by normal weight hydraulic concrete, lightweight concrete, any type of concrete, mortar or cement paste and the thermal and acoustic insulating materials the blocks are made of to form the mezzanine or rooftop walls and slabs.

Another objective of the present invention is for the walls and slabs—formed by normal weight hydraulic concrete blocks, lightweight concrete, mortar or cement paste and the thermal and acoustic materials—to be of an apparent finish to avoid thick mortar plasters. This results in savings on materials, labor and execution time plus offers the advantage that the surfaces of the walls and slabs allow nails, grooves, cuts or patches.

Another objective of the present invention is to offer safety due to the integrity of the walls and slabs formed by normal hydraulic concrete blocks, lightweight concrete or mortar, thermal and acoustic insulating materials and fire resistance provided by the superficial layer of concrete.

Another objective of the present invention is to provide conduits for electric installations and pipes less than 2" in diameter. The conduits are also for hydraulic and sanitary installations. The conduits are embedded inside the walls and slabs formed by the normal weight hydraulic concrete precast blocks, whether of lightweight concrete, mortar or paste and kept protected by the thermal and acoustic insulating materials.

BRIEF DESCRIPTION OF THE SEVERAL VIEWS OF THE DRAWINGS

Description of Normal Weight Hydraulic Concrete Precast Blocks, Lightweight Concrete, any Type of Concrete, Mortar or Cement Paste, Steel Reinforcement and Thermal and Acoustic Insulating Materials for the Fabrication of Mezzanine and Rooftop Walls and Slabs.

The characteristic details of the present invention are clearly depicted in the following description and in the drawings accompanying it as illustrations of the same in the shown figures.

DETAILED DESCRIPTION OF THE INVENTION

Figure 1:
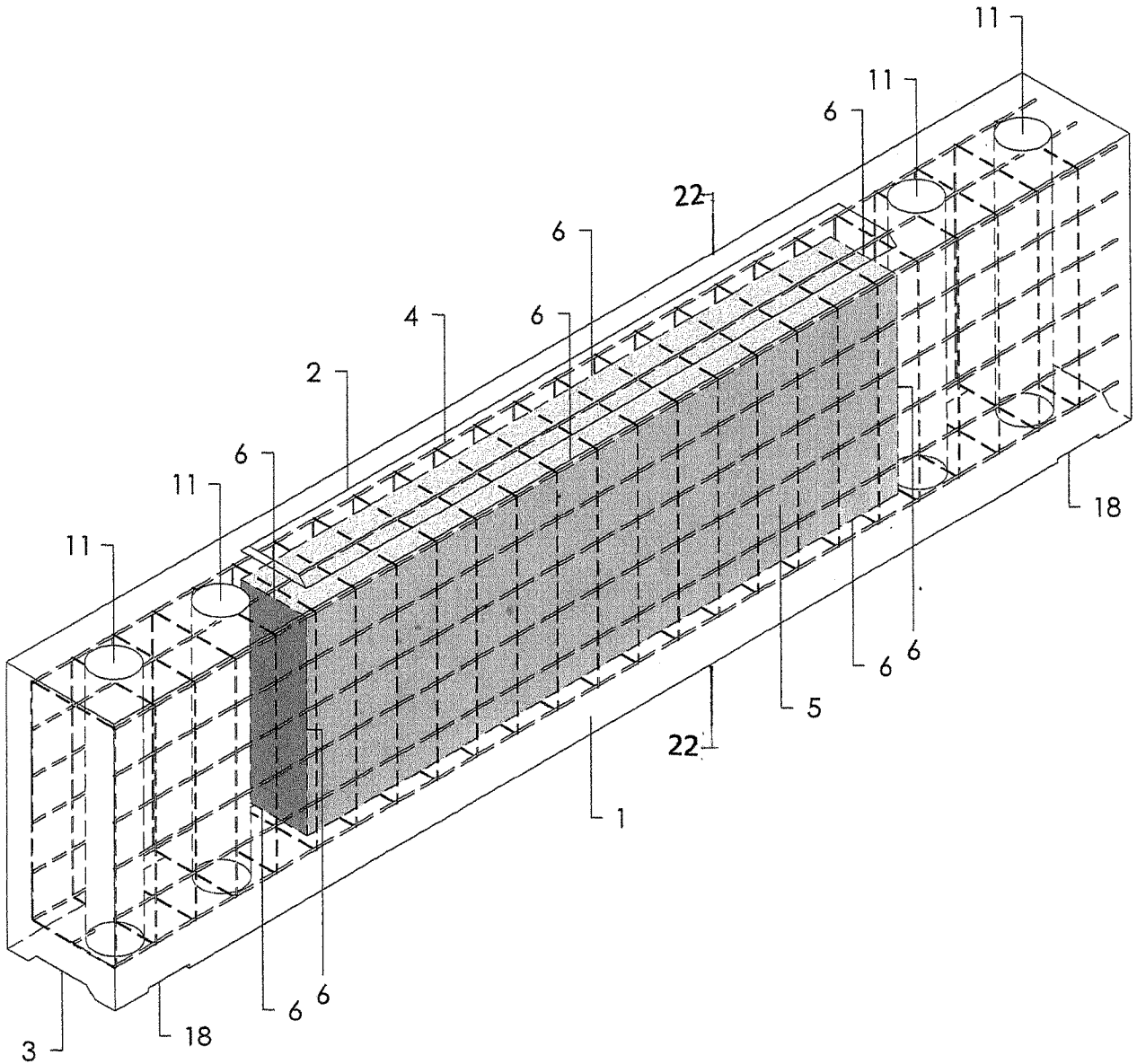
FIG. 1 shows an isometric view with all the elements that make up the precast block for walls.

The present invention consists of a precast block and installation system for the construction of normal weight hydraulic concrete, lightweight concrete, any type of concrete, mortar or paste, electromesh reinforcement and/or steel rods and thermal and acoustic insulating materials including hollow ones for mezzanine and rooftop walls. The precast block of the present invention may be made of aggregates and cementitious materials.

Referring to FIGS. 1-8, the precast block for construction of walls is a rectangular or quadrangular prism-shape block the same length of the wall (L) to which it is a part. It has a base (B) with a measure that depends on the load to bear and the thickness of the thermal insulation that is required. It has a block height (D) that depends on the modulation given by the height of the wall and the height of the closure and parapets of doors and windows.

Referring to FIGS. 1, 5, 6 and 7, the precast block for walls consists of a casing (1) of variable thickness made of normal weight hydraulic concrete, lightweight concrete, any type of concrete, mortar or paste. The casing (1) for the precast block for walls has a thickness of 0.2" to 4" of normal weight hydraulic concrete, lightweight concrete or any other type of concrete, mortar, paste or any construction material using an agglomerating agent, aggregates and water. The precast block has a compression resistance of at least 356 lb/in$^2$. The wall that will become a part thereof ranges in length (L) between 6.3" and 66 ft. and has a width (B) between 1" and 2 ft. and is dependent on the load to bear and the thickness of the required insulation. The block height (D) is between 6" and 4 ft., depending on the modulation per the height of the wall, the heights of closures and parapets of doors, windows and wall openings.

As reinforcement, between the exterior wall (22) and the interior wall (6) of the casing there is a steel wire of quadrangular or rectangular electromesh tube (4) (See e.g., FIGS. 1, 4, 6-8) similar to the shape of the exterior casing of the precast block lengthwise (L) that can be reinforced or replaced with straight steel rods (7) (see FIG. 8) and abutments also made of steel rods having the same tubular shape lengthwise (L) as the precast block for construction of walls.

Figure 8:
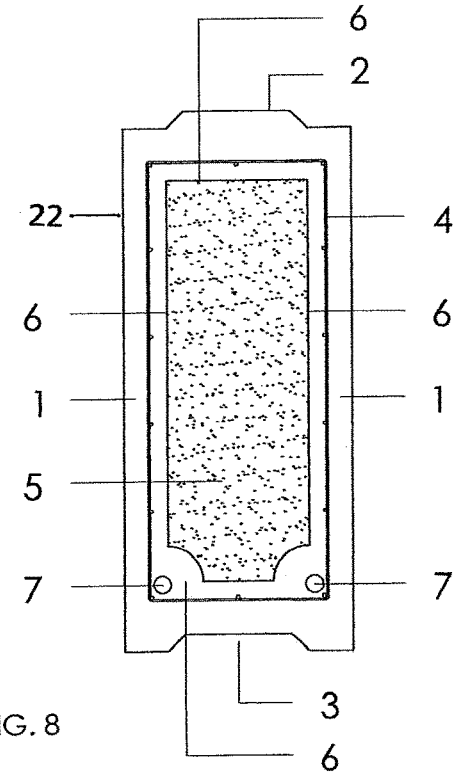
FIG. 8 shows a transversal cut with steel rod reinforcement in the precast block for walls.
Figure 9:
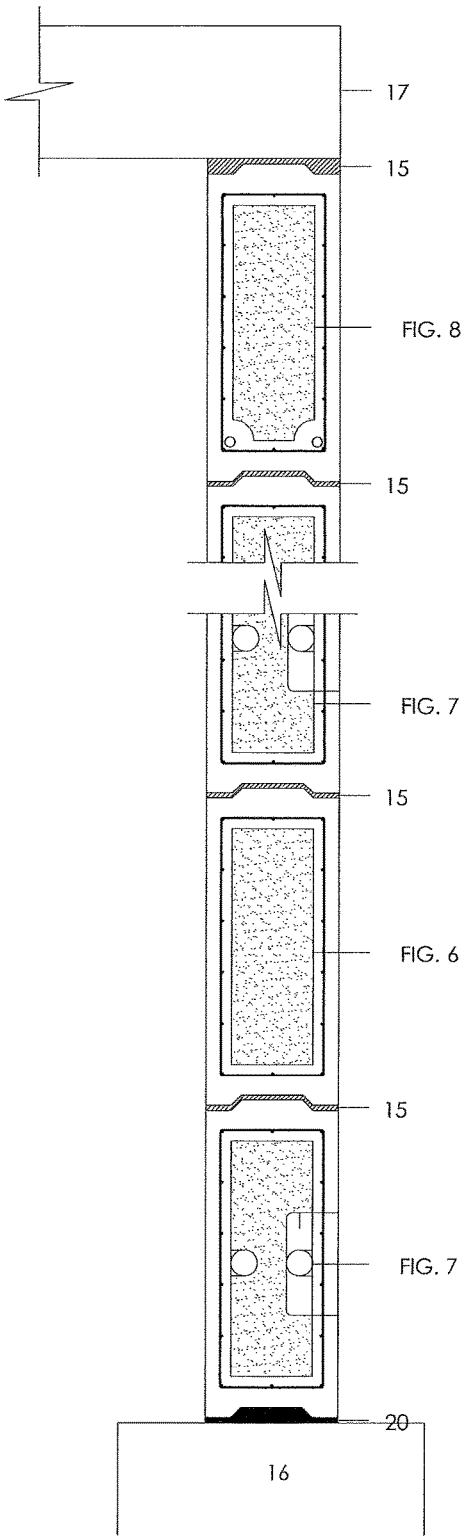
FIG. 9 shows a vertical cut of the union of blocks to form a wall.
Figure 10:
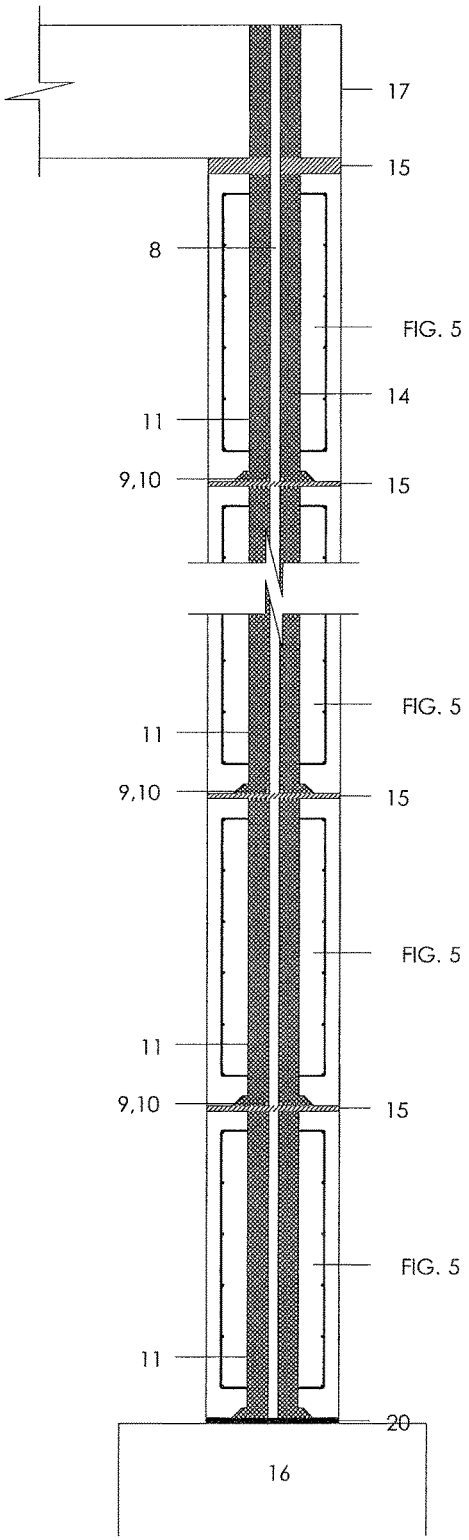
FIG. 10 shows a vertical cut of the reinforcement in the union of blocks to form the intersection, whether in a 2 wall corner at a right angle or in a 3 wall corner also at right angles.

The reinforcement of steel rods and abutment is placed within the precast block between interior and exterior casing walls lengthwise (L) (see e.g., FIG. 8). The reinforcement area of the longitudinal steel is between 0.0005 and 0.0533 of the area of the precast block for walls transversal section. The area of the transversal steel reinforcement is between 0.16 in$^2$ and 1.5 in$^2$ per linear feet of the precast block for walls, throughout the length (L) of the precast block.

Figure 2:
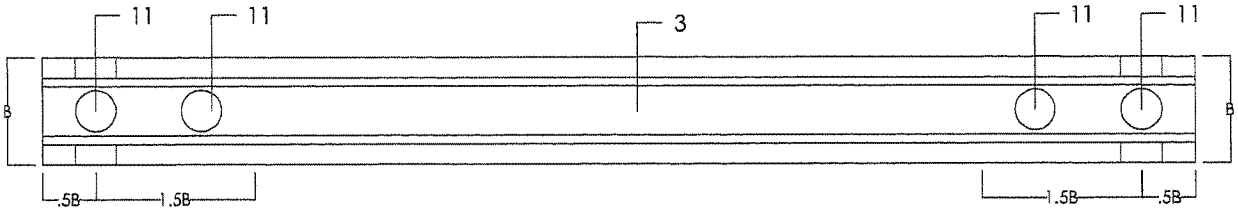
FIG. 2 shows a bottom view of the precast block for walls.
Figure 3:
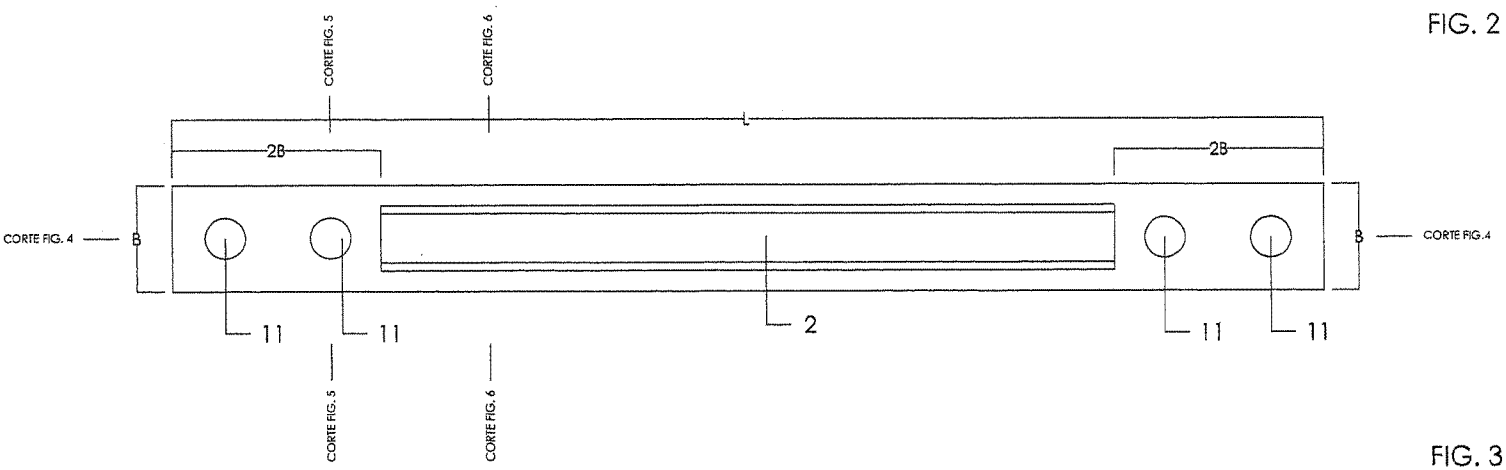
FIG. 3 shows a top view of the precast block for walls.

On the top side of the casing of the precast block for walls and as a part thereof, there is an aligned dowel-shape protrusion (2) on the block lengthwise (L) of the tongue and groove or assembly dowel, except for at both ends at a length of (2B) (see FIG. 3). On the bottom side of the casing and as a part thereof, there is a socket-shape groove (3) corresponding to the tongue and groove lengthwise (L), as shown in FIGS. 1 and 2 (see also, FIGS. 6-8).

Figure 4:
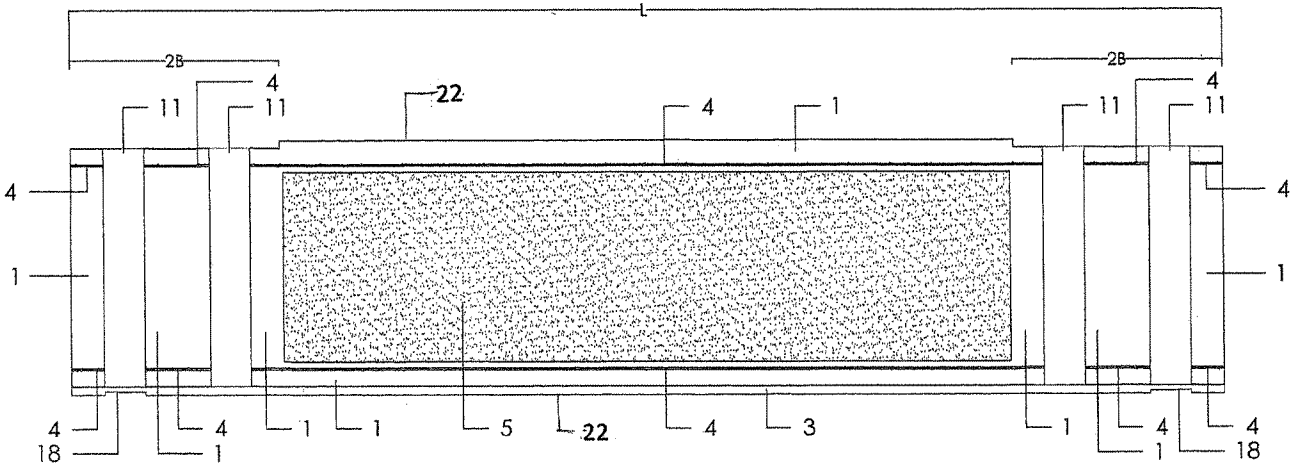
FIG. 4 shows a vertical longitudinal cut of the precast block for walls.
Figure 5:
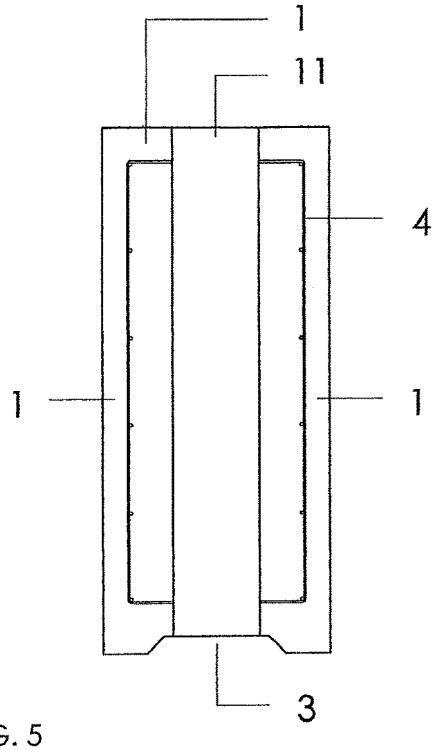
FIG. 5 shows a transversal cut of the ends of the precast block for walls.
Figure 6:
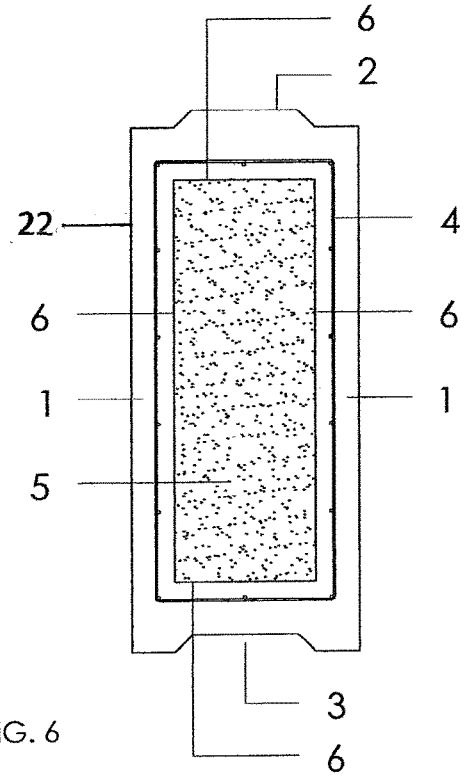
FIG. 6 shows a transversal cut of the central part of the longitudinal body of the precast block for walls.

Referring to FIGS. 1, 4, and 6-8, within the block, a hollow internal space—which has acquired a quadrangular or rectangular prism-shape defined by the interior wall (6) of the casing—can be filled throughout the precast block in the longitudinal hollow space with a lightweight thermal and acoustic insulating material (5). The acoustic and thermal insulating material (5) is comprised of expanded polystyrene, polyurethane foam, vermiculite, mineral or glass stone wool, cellulose or polyethylene foam, aerogel, air or any other insulating material. The acoustic and thermal insulating material (5) acquires the same configuration as the hollow space and runs throughout the precast block, except for at both ends, at a distance of (2B), or in other words, (L-2B), from the edges of the block itself, as shown in FIG. 4.

In each one of the ends of the block, there are two vertical cylinder shape perforations or holes (11) in transversal relationship to the wall length. The cylindrical perforations are 2" to 4" in diameter, are at the same height as the block height (D) and are located at the center of the base (B). For the cylindrical perforations closest to the end of the precast block and for the cylindrical perforations furthest to the end of the precast block, the distance of these are 5 B and 1.5 B, respectively, from the edges of the precast block, as shown in FIG. 2.

Figure 11:
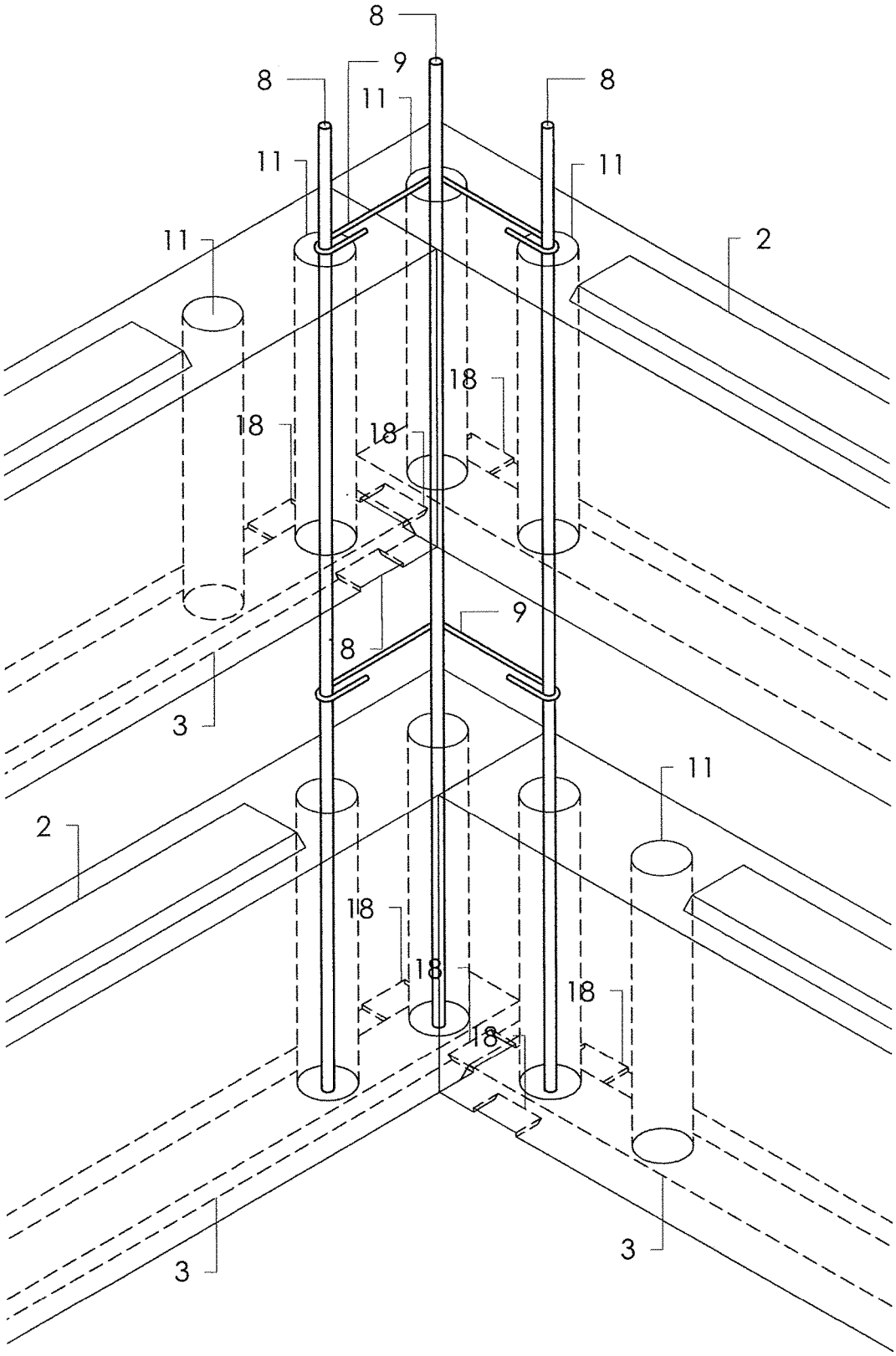
FIG. 11 shows an isometric view of the union of precast blocks to form a two wall corner at a right angle.
Figure 12:
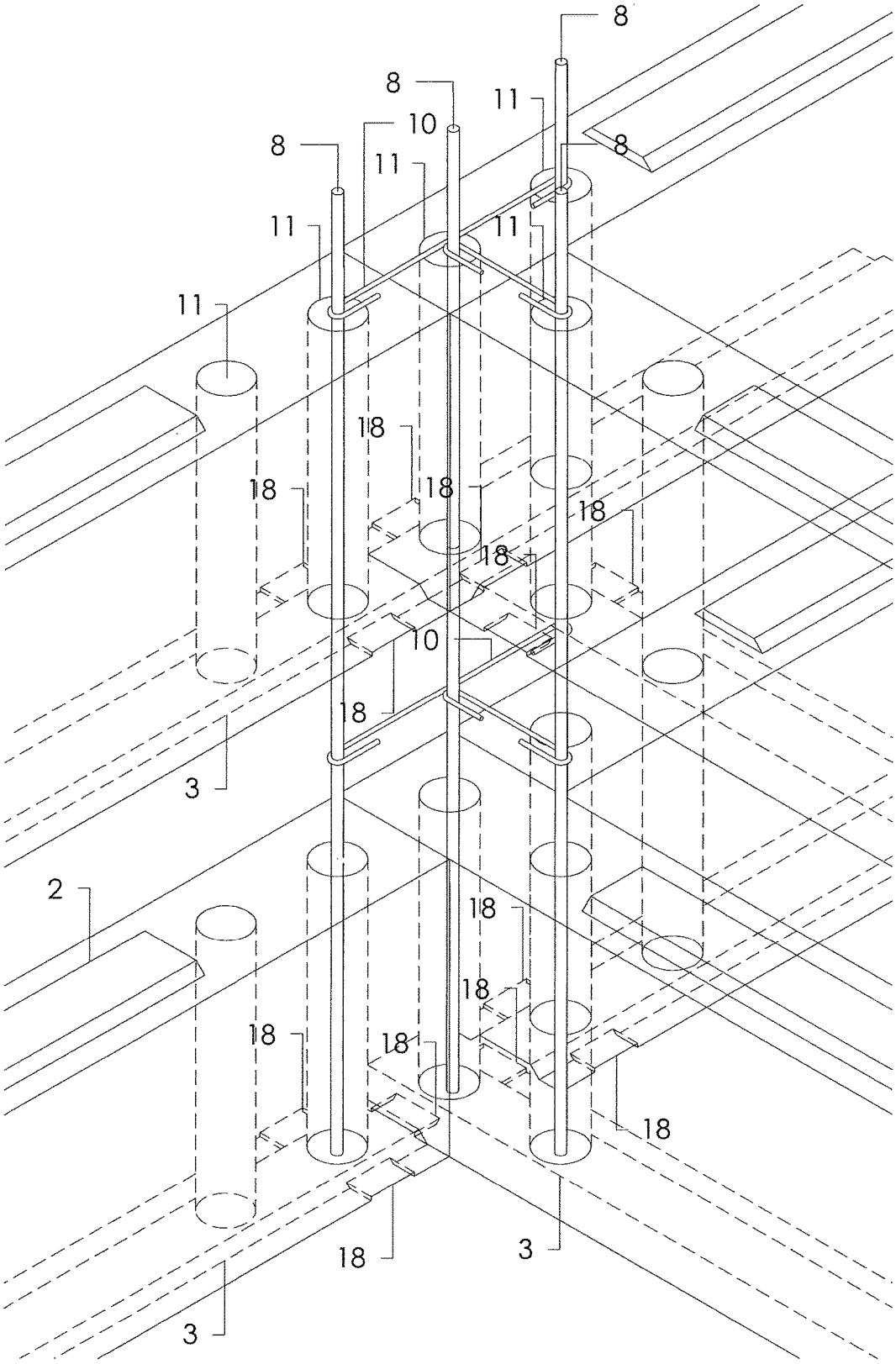
FIG. 12 shows a horizontal cut of the reinforcement of the union of precast blocks to form an intersection of three walls at right angles.

Referring to FIG. 1, the block has a groove (18) transversal to the socket portion of the tongue and groove at a distance of 0.5 B from the center of the groove to each edge of the bottom side of the precast block for construction of walls to fasten a portion of the abutment of the headframes formed in the corners or "T" intersections of the walls (see also FIGS. 4, 11, 12). The groove (18) has a width of 2" to 4" (equal to the base) and is ¾" in height.

Referring now to FIGS. 1-2, a dowel tongue and groove protrusion or assembly tongue of the same material as the precast block for walls is integrated on the top side of the casing (1) of the precast block for walls and forms a part thereof. The dowel protrusion (2) may be in the configuration of either isosceles trapezoid-shape, square, rectangular, semicircular, triangular or any polygonal that serves for the before described purpose. The dowel protrusion (2) is aligned along the length of the precast block, except for a length of (2B) on each end of the block, as shown in FIGS. 3 and 4. The block height ranges from 0.004" to 4" and the block thickness at its base is from (0.1B) to (1B) of the precast block, as shown in FIG. 2.

On the bottom side of the precast block for walls casing and as a part thereof and of the same material, there is a groove socket shape (3) of the tongue and a groove or slot matching the shape of the dowel protusion (2), as shown in FIGS. 1, and 4-8. As shown in FIGS. 9-12, the measure of block height and width at its base allows one precast block to connect to another similarly sized precast block, lengthwise (L), to form the wall by setting and adhering the precast blocks together with a cement-sand mortar, block adhesive or similar adhesive.

Figure 7:
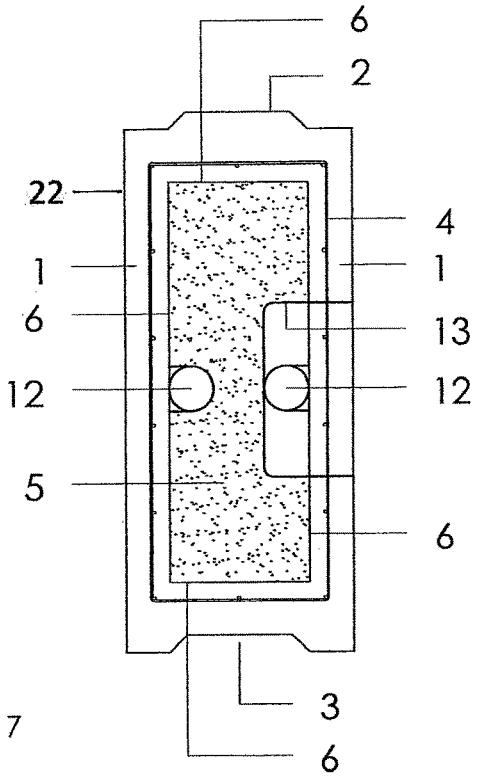
FIG. 7 shows a transversal cut with electric installation ducts in the precast block for walls.

For the fabrication of the wall, the precast blocks of the present invention are vertically placed throughout and at the same length (L) of the wall or jamb, one on top of another, matching tongue and groove (e.g., dowels and socket grooves). The blocks are set and joined using a mortar. That is, while setting the blocks one on top of another, they are glued together with a cement base mortar, block adhesive or similar adhesive lengthwise (L). The precast block for walls can contain a plurality of ducts (12) ½" to 1½" in diameter. The plurality of ducts (12) is housed inside the interior space confined by the interior wall of the block casing and at half the block height (D), as shown in FIG. 7. Blocks containing ducts are placed at corresponding height levels of an electrical outlet, switch or sconce for the electrical installation. At the height of the closures of doors, windows or even larger wall openings, one or more reinforced blocks are installed.

More specifically, the precast blocks will be installed one on top of each other to set the tongue and groove system joined with an adherent material, whether cement base mortar, block adhesive or similar adhesive (15) (see FIGS. 9, 10, 13, 14). The precast blocks for walls with electric ducts are placed at the corresponding height for the electrical installation, whether for electric outlet, switches or sconces. At the closures height, one or several precast blocks for walls will be installed using straight steel rods (7) as extra reinforcement besides the electromesh (4), as shown in FIG. 8 (see also FIGS. 9, 15, 20, 21, 22, 23). The first base block will be set on top of the foundation through an adherent material that includes a waterproofing system to avoid moisture from rising up the wall (20) (see FIGS. 9 and 10).

Referring now to FIGS. 11, 12, 13 and 14, in the unions of two walls to form a corner (FIG. 11, 13) or three walls in a "T" shape (FIGS. 12, 14) at right angles, the reinforced connection is done by overlapping the blocks in an alternate way setting and adhering them with cement base mortar, block adhesive or similar adhesive (15). Vertical cylindrical hollows (11) at the end of the blocks are then vertically aligned starting from the ends of the blocks to form the headframes. In the case of corner walls, three vertical steel rods (8) are inserted in the vertical cylindrical hollows (11) ("armed vertical cylindrical hollows") with steel rods (in transversal relationship to the vertical steel rods) forming steel abutments (9) which connect to and reinforce the vertical cylindrical rods (8). The steel abutments (9) are placed in each horizontal joint between blocks (See FIGS. 11, 13). In the case of "T" walls, four vertical steel rods (8) are inserted in the vertical cylindrical hollows (11) reinforced with steel rod abutment (10) in each horizontal joint between blocks (See FIGS. 12, 14). A portion of the abutments will be housed in the transversal grooves located in the base (B) of the precast blocks for walls. In this position, the abutments further reinforce the headframes for the walls.

Figure 14:
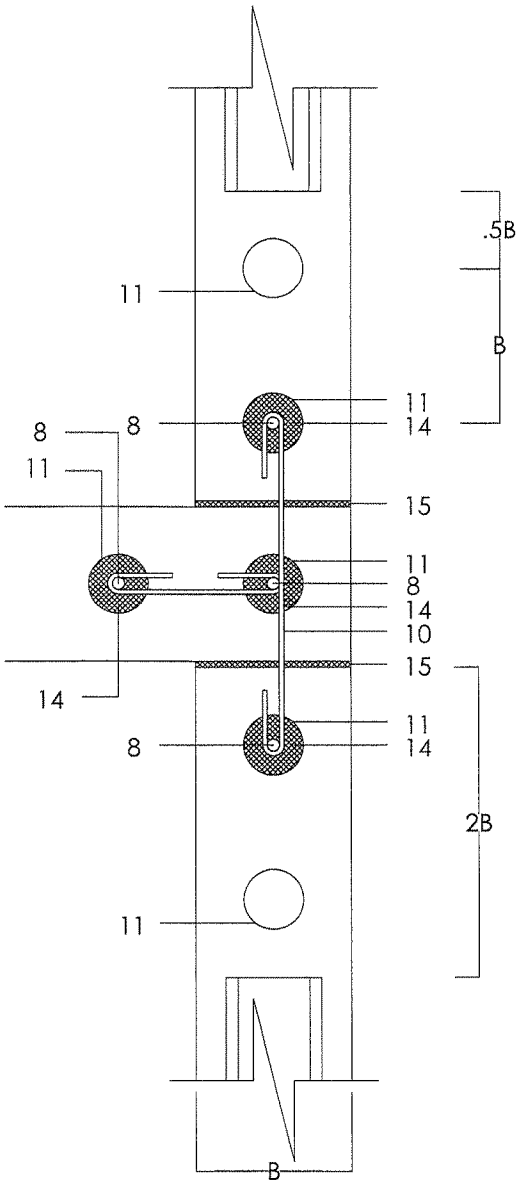
FIG. 14 shows a horizontal cut of the reinforcement of the union of precast blocks to form an intersection of three walls at right angles.
Figure 13:
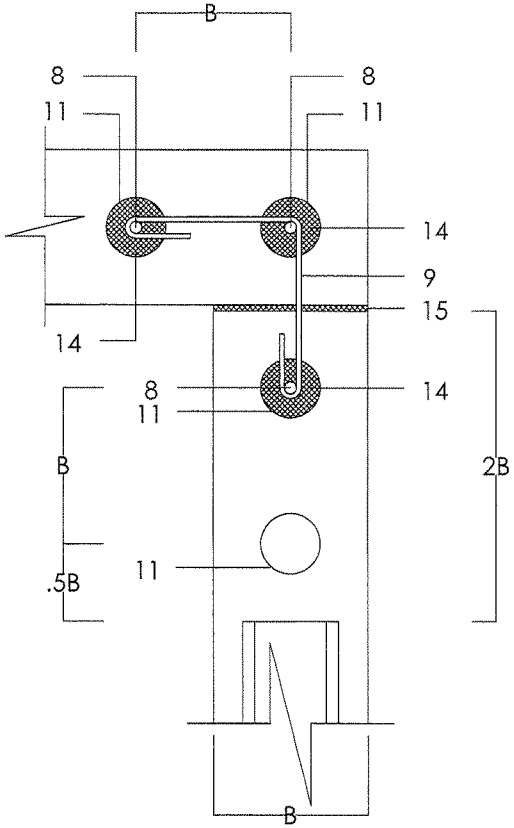
FIG. 13 shows a horizontal cut of the reinforcement of the union of precast blocks to form an intersection of two walls at a right angle.

The embedding of the headframes will be done using vertical rods (8) housed inside the vertical hollows (11) from the foundation up to the mezzanine or rooftop precast slabs. More particular, the embedding of the armed headframes into the foundation of corner or "T" intersections of the walls made with the precast blocks of the present invention is done by elongating the vertical steel rods (8) down into the necessary depth of the foundation, according to the type of foundation or system. Vertical cylindrical hollows (11) are filled with a grout (14), as shown in FIGS. 13 and 14. A very fluid, easy to handle mortar or other similar material with a compression resistance of more than 2844 lb/in$^t$ and which has no contraction due to drying may also be used and still remain within the contemplation of the present invention.

Referring now to FIGS. 15, 16, 17 and 18, the precast block for the construction of mezzanine and rooftop slabs is comprised by a rectangular or quadrangular prism shape concrete block. The precast block for slabs includes a length (L') of the slab plus the supports, a base width (B') depending on the modulation of the slab transversal width, and a block height (D') depending on the measure of the calculation memory, specifications, along with the insulation that is required. The precast block for slabs has a compression resistance of at least 356 lb./in$^2$ and a length (L') of the slab of up to 66 ft. plus supports. The base width (B') of the precast block for slabs can range from 4" to 6.6 ft., depending on the modulation of the transversal width of the slab. The block height (D') is between 4" and 2 ft., depending on structural calculation and the need for insulation.

Figure 15:
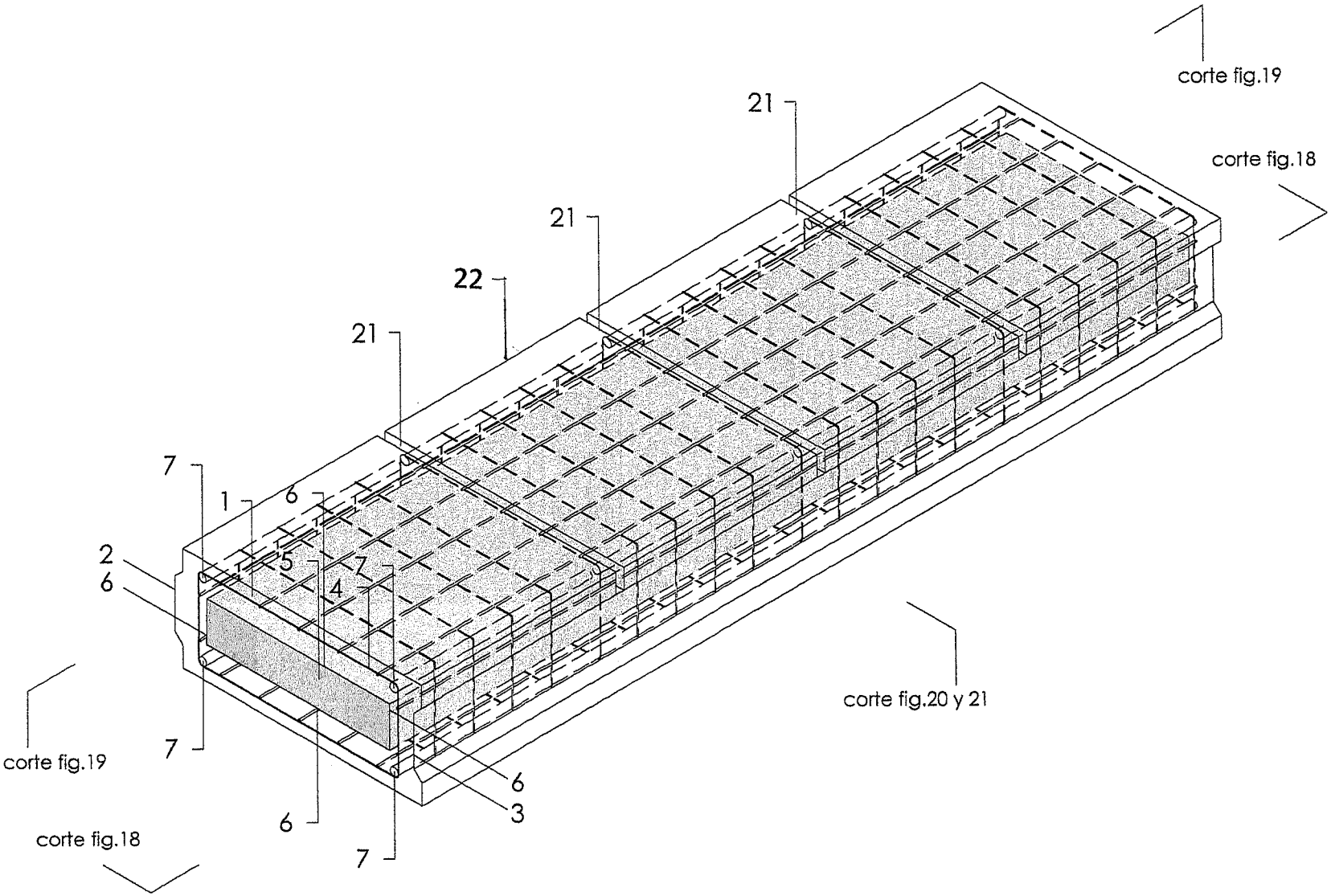
FIG. 15 shows an isometric view with all the elements that form the precast block for slabs.
Figure 16:
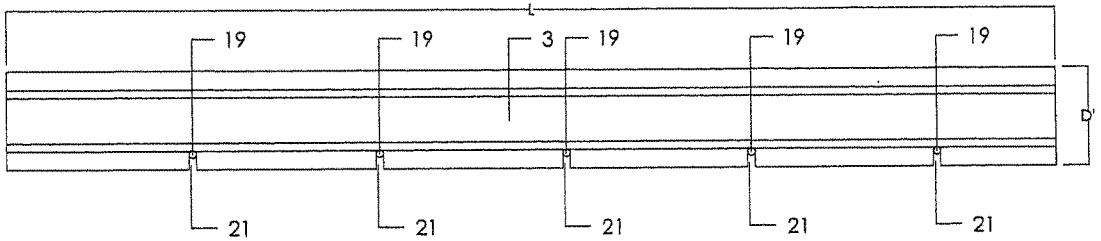
FIG. 16 shows the side view with a tongue and groove dowel system of the precast block for slabs.
Figure 17:
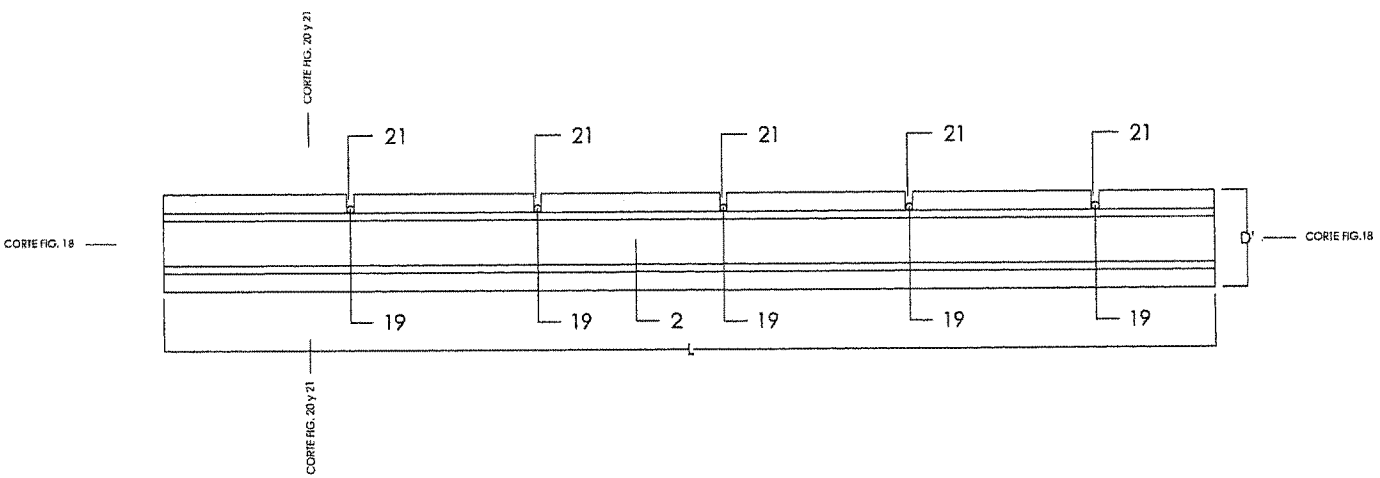
FIG. 17 shows the side view with a tongue and groove socket system of the precast block for slabs.
Figure 18:
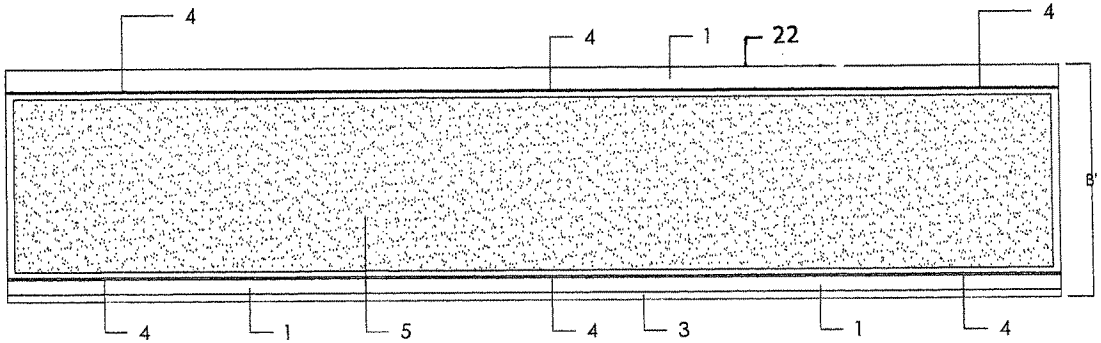
FIG. 18 shows a horizontal longitudinal cut of the precast block for slabs.
Figure 19:
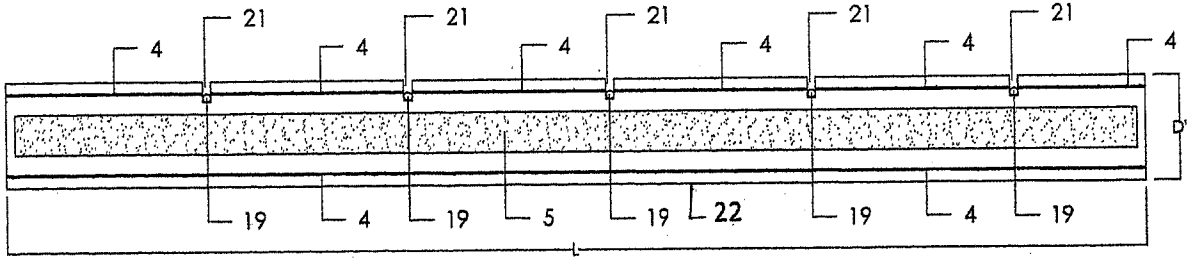
FIG. 19 shows a vertical longitudinal cut of the precast block for slabs.

Referring now to FIG. 15, the precast block for slabs consists of a casing (1) of variable thickness in the range of 0.2" to 6" made of normal weight hydraulic concrete, lightweight concrete, any type of concrete, mortar or paste. Other material, such as material for construction made of agglomerating agents, aggregates and water, may also be used and still be within the contemplation of the present invention.

Figure 23:
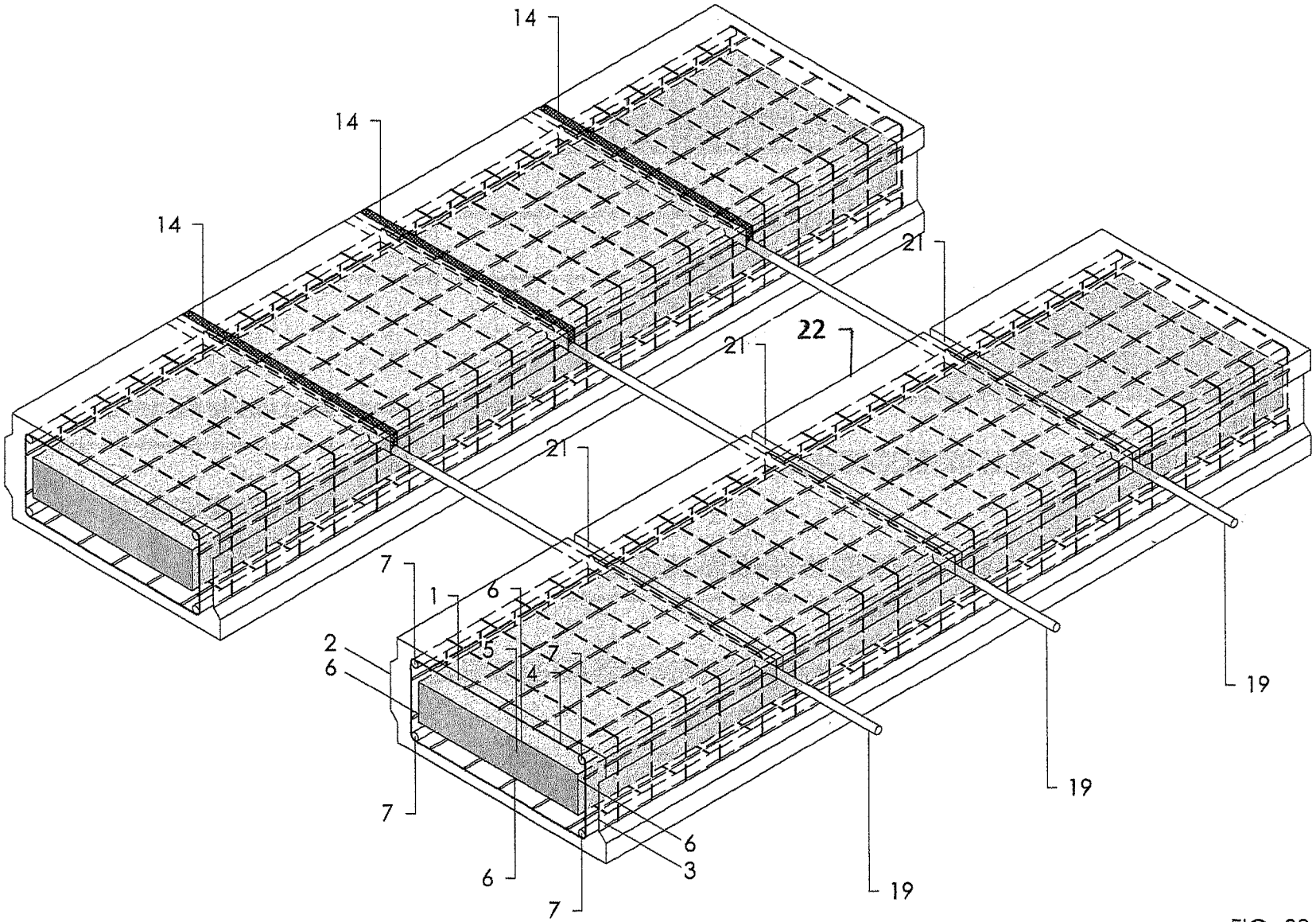
FIG. 23 shows an isometric view of the union of the blocks for slabs with the retraction and temperature reinforcement.

As reinforcement, between the exterior wall (22) and the interior wall (6) of the casing (1) there is a steel wire quadrangular or rectangular electromesh tube (4) similar to the shape of the exterior casing of the precast block, as shown in FIGS. 15 and 23. The electromesh (4) may be reinforced or replaced with straight longitudinal steel rods (7) and abutments throughout the length of the block (L').

Figure 21:
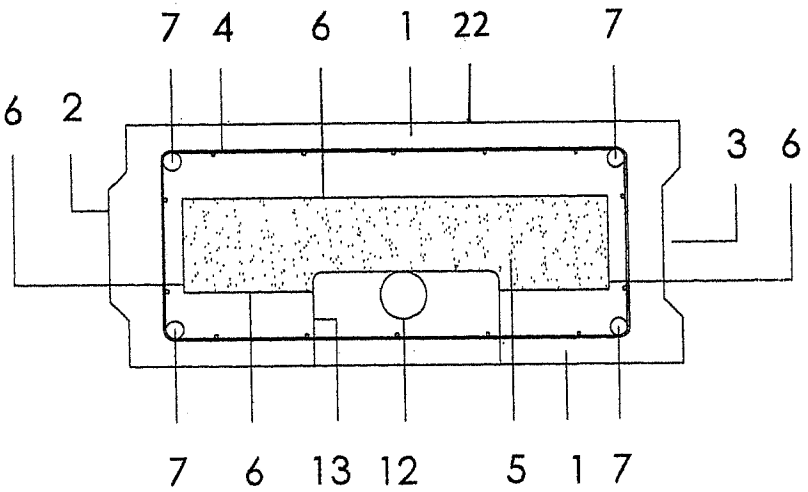
FIG. 21 shows a transversal cut with electric duct of the precast block for slabs.
Figure 20:
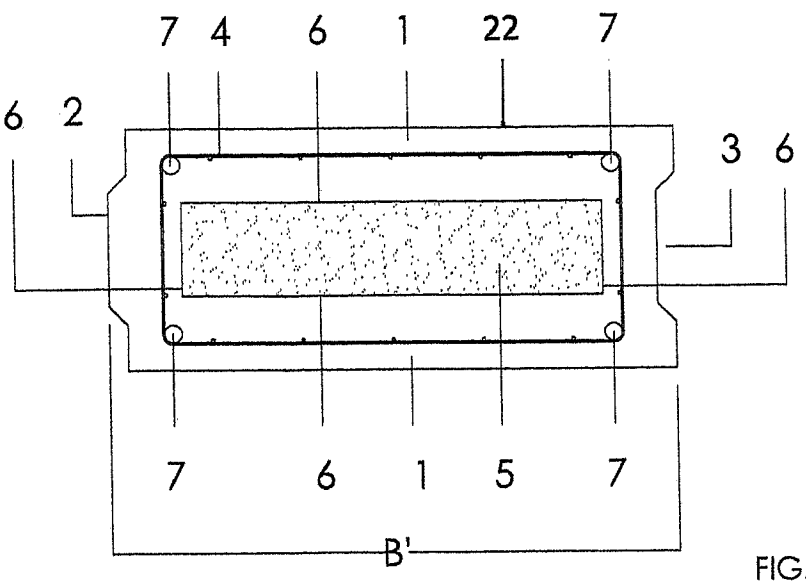
FIG. 20 shows a transversal cut of the precast block for slabs.

The reinforcement straight steel rods (7) and abutments are between the exterior and interior walls (22, 6) of the block casing (1) and traverse throughout the length (L') of the precast block, as shown in FIGS. 20 and 21. This is the longitudinal reinforcement steel area, whether electromesh or rod. The reinforcement is of 0.0012 and 0.068 of the area of the transversal section of the precast block for slabs. The reinforcement steel area, whether comprised by the electromesh (4) or the rods (7) of the abutments, is between 0.16 $in^2$ and 2.62 $in^2$ per linear feet of the reinforcement of the precast block for slabs, lengthwise (L'). The reinforcement areas will depend on the calculation memory run to resist its own loads and working loads on the slab.

As shown in FIGS. 20 and 21, on one lateral side of the casing (1) and as a part thereof, there is a dowel protrusion (2) of the tongue and groove that traverses lengthwise (L') along the block for the slab. The configuration of the dowel protrusion (2) can be of an isosceles trapezoid shape or of other configurations such as square, rectangular, semicircular, triangular or any polygonal shape. The dowel protrusion (2) is aligned throughout and along the length (L') of the precast block for slabs. The dimensions of the dowel protrusion (2) include a block height in a range of 0.04" to 6" and a base width ranging from (0.1 D') up to (1.0 D') of the precast block for slabs.

On the other lateral side of the casing (1) and as part of the casing (1), there is a socket groove (3) of the tongue and groove system which traverses lengthwise along the same block. The socket-shape groove (3) is of corresponding configuration to and matable with the dowel protrusion (2) and has the same block height and base width dimensions to fit into another similarly configured precast block for slabs along its length (L') to form the slab by setting and gluing them together using a cement-sand mortar, block adhesive or similar adhesive.

Referring to FIGS. 15, 18-19, 22 and 23, inside the precast block for slabs, the hollow internal space which has acquired a rectangular or quadrangular prism shape defined by the interior wall (6) and exterior wall (22) of the casing, can be filled with an acoustic and thermal insulating lightweight material (5) or with air, lengthwise (See also e.g., FIGS. 20 and 21). The acoustic and thermal insulating material (5) is comprised of expanded polystyrene, polyurethane foam, vermiculite, mineral or glass stone wool, cellulose or polyethylene foam, aerogel, air or any other insulating material. The acoustic and thermal insulating material acquires the same shape as the hollow internal space.

Referring now to FIGS. 15, 16, 17 and 19, there are between ¾" or 2" width and depth transversal longitudinal grooves (21) on the top compression layer of the precast block for slabs with the necessary separation according to the retraction calculation due to temperature changes. The grooves (21) may also be 1 3/16" in width and have a depth in the range of 0.40" to 2". The separation or distance between each groove (21) is in the range of 8" and 4 ft., depending of the reinforcement calculation to counteract the retraction per slab temperature. To avoid temperature retraction, steel rods (19) are placed in the same grooves and filled with grout (14) or similar mortar, as shown in FIG. 23. The grout is a non-ferrous grout or very fluid mortar, easy to handle, with a minimum compression resistance of 2844 $lb/in^2$ without contraction due to drying.

The precast block for slabs can house a duct (12) for electric installations inside the lightweight material prism. This poliduct (12) is placed at the center of the base (B'), as shown in FIG. 21, or elsewhere according to the needs of the mezzanine or rooftop slab.

Figure 22:
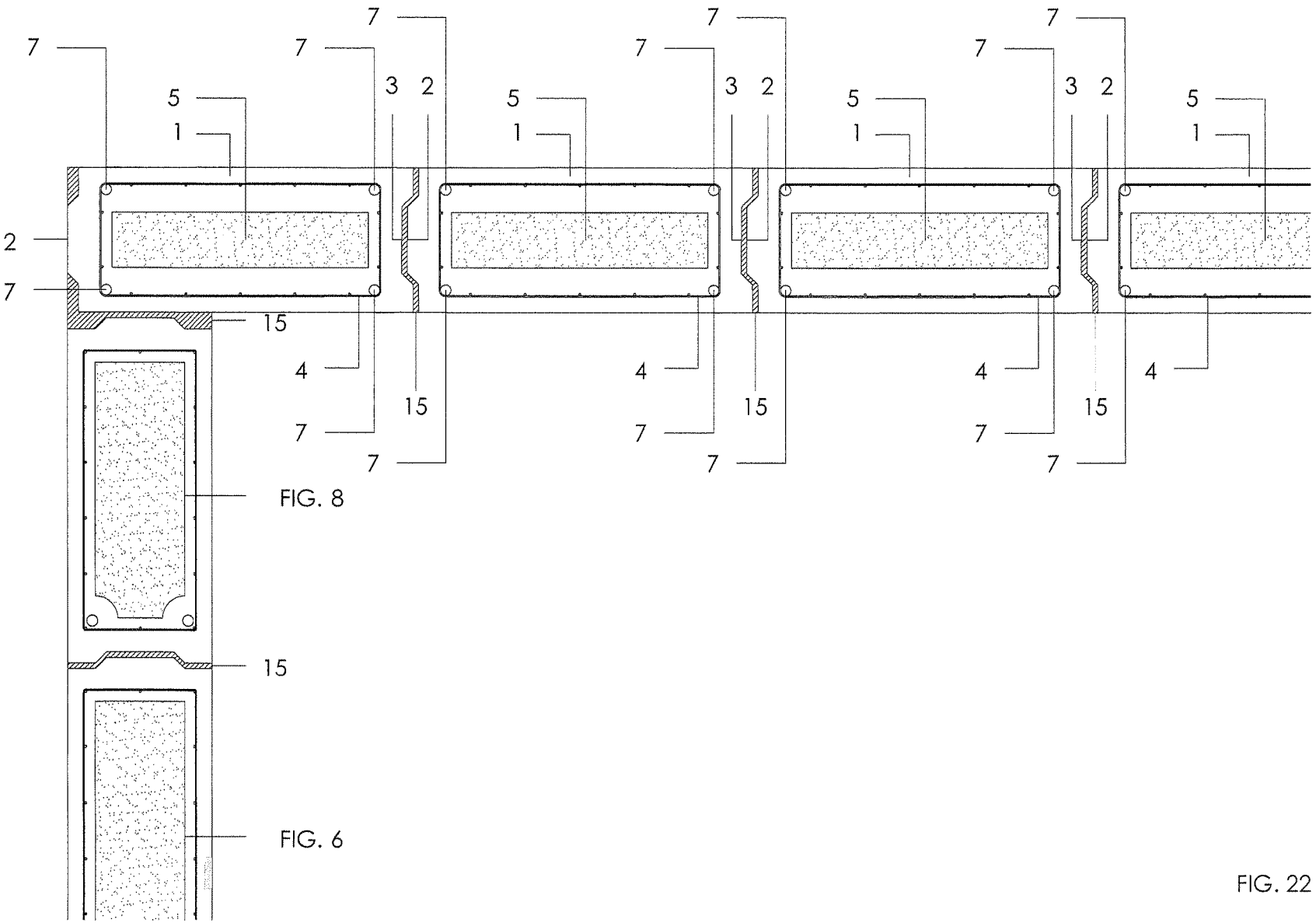
FIG. 22 shows a transversal cut of the union of precast blocks to form a slab.

For fabricating a mezzanine or rooftop slab, the precast blocks are placed horizontally on their base (B') over supports so that the lateral dowel protrusion (2) of the tongue and groove system mates with the corresponding socket-shape groove (3) to join two or more precast blocks together, as shown in FIG. 23. More specifically, the concrete precast blocks will be set between the walls or support beams, one beside the other matching pin and tail, or mating dowel and groove, of the tongue and groove system, gluing them together along their respective lengths with a cement base adhesive (15), block adhesive or the like, as shown in FIG. 22, and leaving the block with the electric duct where it is projected and by embedding the electrical outlet box (13) on the block, as shown in FIG. 21.

I claim:

1. A precast block system for construction for use on lightened slabs comprising:

a plurality of precast blocks, each precast block comprising:

a casing having a quadrangular prism configuration with an exterior wall and an interior wall and left and right sides, said interior wall defining an internal space therein, a portion of said casing between opposite surfaces of said exterior wall and said interior wall having a thickness in the range of 0.2 inches to 6 inches;

a longitudinal reinforcement steel area within said casing between said exterior wall and said interior wall of said casing, said longitudinal reinforcement steel area further comprises an electromesh tube wherein said internal space is wholly within said electromesh tube:

a tongue and groove assembly comprising:

a dowel protrusion aligned throughout and along the length of the left side of said casing;

a socket groove aligned along the right side of said casing, said socket groove is of a corresponding configuration to and matable with said dowel protrusion of at least one other precast block;

an acoustic and thermal insulating material within said internal space of said casing;

a plurality of transversal longitudinal grooves on a top surface of said casing in transversal relationship to said dowel protrusion and said socket groove such that the plurality of transversal longitudinal grooves extend through the left and right sides of the casing, wherein the plurality of transversal longitudinal grooves of each precast block are coaxially aligned with the transversal longitudinal grooves of at least one other precast block;

a plurality of steel rods, each steel rod provided within respective transversal longitudinal grooves that are coaxially aligned with one another;

grout within said coaxially aligned transversal longitudinal grooves, said grout being non-ferrous and having a minimum compression resistance of 2844 lb./in2;

an adherent adhering said dowel protrusion of at least one precast block with said socket groove of at least one other precast block, said adherent being cement-sand mortar; wherein said at least one precast block is joined with said at least one other precast block; and wherein said plurality of precast blocks are joined to form a T-beam therebetween for additional reinforcement against deformation; and wherein said plurality of precast blocks are intended for use above ground.

2. The precast bock system for construction for use on lightened slabs, as recited in claim 1, further comprising an electrical outlet box embedded within at least one precast block.

3. The precast bock system for construction for use on lightened slabs, as recited in claim 2, wherein said longitudinal reinforcement steel area further comprises a steel rod which traverses the length of said casing.

4. The precast bock system for construction for use on lightened slabs, as recited in claim 3, wherein said acoustic and thermal insulating material is polystyrene.

5. The precast bock system for construction for use on lightened slabs, as recited in claim 3, wherein said acoustic and thermal insulating material is air.

6. The precast bock system for construction for use on lightened slabs, as recited in claim 3, wherein said precast blocks have a length of up to 66 ft.

7. The precast bock system for construction for use on lightened slabs, as recited in claim 6, wherein said precast blocks have a base width in the range of 4 inches to 6.6 feet.

8. The precast bock system for construction for use on lightened slabs, as recited in claim 7, wherein said precast blocks have a height in the range of 4 inches to 2 feet.

* * * * *